US009103165B2

(12) United States Patent
Purcell

(10) Patent No.: US 9,103,165 B2
(45) Date of Patent: Aug. 11, 2015

(54) DOWN-THE-HOLE HAMMER

(75) Inventor: Joseph Purcell, Ennis (IE)

(73) Assignee: MINCON INTERNATIONAL, Shannon, Co. Clare (IE)

( * ) Notice: Subject to any disclaimer, the term of this patent is extended or adjusted under 35 U.S.C. 154(b) by 207 days.

(21) Appl. No.: 13/878,242

(22) PCT Filed: Oct. 17, 2011

(86) PCT No.: PCT/EP2011/068136

§ 371 (c)(1),
(2), (4) Date: Apr. 8, 2013

(87) PCT Pub. No.: WO2012/049331

PCT Pub. Date: Apr. 19, 2012

(65) Prior Publication Data

US 2013/0186692 A1 Jul. 25, 2013

(30) Foreign Application Priority Data

Oct. 15, 2010 (IE) ..... S2010/0666

(51) Int. Cl.
*E21B 4/14* (2006.01)
*E21B 6/08* (2006.01)
*E21B 17/07* (2006.01)

(52) U.S. Cl.
CPC ... *E21B 4/14* (2013.01); *E21B 6/08* (2013.01); *E21B 17/076* (2013.01)

(58) Field of Classification Search
CPC ..... E21B 4/06; E21B 4/10; E21B 4/14
See application file for complete search history.

(56) References Cited

U.S. PATENT DOCUMENTS

| | | | | |
|---|---|---|---|---|
| 3,517,754 | A * | 6/1970 | Hughes | 173/104 |
| 5,131,476 | A * | 7/1992 | Harrington | 173/17 |
| 5,207,283 | A | 5/1993 | Lay | 175/296 |
| 2007/0045009 | A1 * | 3/2007 | Gien | 175/417 |
| 2007/0089908 | A1 | 4/2007 | Underwood | 175/57 |
| 2010/0044111 | A1 | 2/2010 | Marshall | 175/293 |
| 2010/0108395 | A1 * | 5/2010 | Purcell | 175/296 |

FOREIGN PATENT DOCUMENTS

| | | | |
|---|---|---|---|
| WO | WO 97/43515 | 11/1997 | E21B 10/36 |
| WO | WO 2007/010513 A1 | 1/2007 | E21B 4/14 |

OTHER PUBLICATIONS

Int'l Search Report from corresponding PCT/EP2011/068136 (Form PCT/ISA/210); 5 pages.

* cited by examiner

*Primary Examiner* — William P Neuder
(74) *Attorney, Agent, or Firm* — Kusner & Jaffe

(57) ABSTRACT

The present invention relates to a down-the-hole hammer comprising an external cylindrical outer wear sleeve (5), a sliding piston (8) mounted for reciprocating movement within the outer wear sleeve to strike a percussion bit (1) of a drill bit assembly located at the forward end of the outer wear sleeve. The drill bit assembly comprises a percussion bit having a head portion formed with an axially extending stub shank (32); axially extending splines (36) on the stub shank slideably engageable with complementary splines (35) formed on a drive chuck (4) whereby rotational drive from the chuck may be transmitted to the stub shank; a bit retaining ring (141) adapted for engagement with a retaining shoulder (37) on the stub shank to retain the stub shank in the drill bit assembly; and engagement means on the chuck adapted for connecting the chuck to a drive means of the fluid-operated percussion drill tool; the bit retaining ring comprises a shoulder (144) for engagement with an upper end of the chuck to hold the retaining ring in place in the assembly. The assembly further comprises a bushing (61) arranged above the chuck. An upper portion of the bushing has an internal diameter (B) dimensioned to provide a sealing fit with the piston nose (20). The bit retaining ring or the lower portion of the bushing has an internal diameter (E) dimensioned to provide a close sliding fit with the outer diameter of the retaining shoulder (37) on the stub shank (32).

18 Claims, 13 Drawing Sheets

SECTION Y-Y

SECTION Z-Z

SECTION W-W

DOWN-THE-HOLE HAMMER

FIELD OF THE INVENTION

The present invention relates to a down-the-hole hammer. In particular, the invention concerns maximising lift force in a hammer design without a footvalve.

BACKGROUND TO THE INVENTION

Some designs of conventional down-the-hole hammers and fluid-operated percussion drill tools comprise an external cylinder or outer wear sleeve, within which is mounted an inner cylinder which in turn engages with a backhead assembly. A sliding reciprocating piston co-operates with the inner cylinder and backhead assembly, which when air pressure is supplied through the backhead assembly, acts with a percussive effect on a drill bit retained within a chuck on the outer wear sleeve.

Typically the inner cylinder is mounted co-axially within the outer wear sleeve. A sliding piston is mounted for reciprocating movement within the inner cylinder and the outer wear sleeve, to strike a hammer bit mounted for sliding movement in a chuck located at the forward end of the outer wear sleeve, in well known manner. A foot valve is positioned above the bit.

Our prior patent application Publication No. WO 2004/031530, discloses a down-the-hole hammer in which the bit has an elongate shank portion which at its upper end has an annular strike face (or anvil) against which the piston impacts to impart a percussive force to the bit. A lower end of the bit shank is formed externally with a plurality of splines, which are spaced around the circumference of the bit shank and extend in the axial direction. The splines slideably engage with complementary splines formed on the internal wall of an annular chuck. The chuck is screw-threadably connected to the bottom of the outer wear sleeve. The bit is retained in the hammer assembly by means of a bit retaining ring, which sits above the chuck and cooperates with an annular shoulder on the bit. This prevents the bit from falling out of the assembly in operation.

In operation the bit shank comes under forces due to the percussive action of the hammer, and rotational torque which is provided by the chuck. This imparts significant bending moments on the upper part of the bit shank increasing the risk of breakage of the shank due to cracking. Drill bits are very expensive to produce, and to recover if they are lost down the drilling hole. That this is a significant problem with the drill bits of conventional down-the-hole hammers is evidenced by the fact that there are a number of patents directed to means of retaining a broken-off bit within the bit assembly so as to prevent it falling down the drill hole. Examples of these patents are U.S. Pat. No. 5,065,827, U.S. Pat. No. 4,003,442, WO 96/15349, WO 98/05476, WO 03/062585, WO 03/062586. However, the inventions disclosed in these patents are directed to dealing with problems which occur after the bit shaft has fractured, and not to preventing the breakage in the first place.

Another disadvantage associated with conventional percussion drill tools, such as down-the-hole hammers, is that the bit has a long shank portion which is expensive to produce. The long shank portion is required in order to provide a splined shank portion of sufficient length to give enough support for transfer of rotational torque, and an area above the splines for retaining the bit. In conventional hammers, when the bit head or cutting face is worn out, the shank can often be in good condition but, because it is made integral with the cutting face, it must be discarded. The premature wearing out of the head/cutting face may occur where drilling is carried out in very abrasive rock or material which wears the tungsten carbide inserts in the cutting head. With many conventional hammers, there is a need to provide foot valves in the bit. The foot valve is required as an integral part of the functioning of the hammer i.e. when the piston is in the strike position, the bottom lift chamber is sealed by the bore of the piston and the outside of the footvalve. If this were not the case then the piston would not lift. The footvalve is prone to occasional breakage leading to down-time.

It is therefore desirable to provide a drill bit assembly for percussion drill tools, in which the length of the bit shank is substantially reduced in comparison to conventional percussion drill tools. However, when the bit is shortened in this way, retaining the bit within the chuck becomes more difficult. Traditional arrangements used for retaining long bit shanks in percussion drill tools, where a bit retaining ring sits above the chuck and cooperates with an annular shoulder on the bit, are not suitable for use with short stub shanks. This is because the maximum length of the drive chuck is limited by the length of the stub shank. As the chuck must include an upper screw thread portion for engagement with the outer wear sleeve, and a lower extension portion to protect the lower end of the outer wear sleeve from excessive wear, each of which must be sufficiently long to perform its intended purpose, it is desirable that the overall length of the chuck be maximised within the limit imposed by the shank length. It is therefore desirable to avoid an arrangement where a bit retaining ring must sit above the chuck, thereby further limiting the maximum length thereof.

Our granted European Patent No. 1 910 640 describes a drill bit assembly for fluid-operated percussion drill tools which overcomes a number of the problems discussed above. The assembly comprises a percussion bit having a head portion formed with an axially extending stub shank. The stub shank is provided with axially extending splines, which are slideably engageable with complementary splines formed on a drive chuck. Rotational drive from the chuck may be transmitted to the stub shank by means of the splines. Bit retaining means at the chuck are adapted for engagement with complementary retaining means at a spline portion of the stub shank to retain the stub shank in the drill bit assembly. Engagement means on the chuck are adapted for connecting the chuck to a drive means of the fluid-operated percussion drill tool.

This arrangement has a number of advantages over conventional systems. Because the means to retain the bit within the chuck has been moved to the splined portion of the stub shank, this assembly allows for a shortened shank and a maximised chuck length. In addition, splined support for transfer of rotational torque is provided both above and below the bit retaining means. A further advantage is that there is no requirement to have a footvalve in the bit. The footvalve and piston cooperation of earlier designs is replaced by the nose of the piston sealing in the bore of a bushing provided in the assembly.

However, there are also a number of disadvantages associated with the arrangement of EP 1 910 640. One such disadvantage is that the replacement of the footvalve with a piston nose which seals in the bore of a bushing is that the structure at the piston nose is relatively weak. In order to counteract this inherent weakness, it is desirable to increase the diameter ØB of the piston nose. However, the lift force applied to the piston in the strike position is given by the area of the pressure face on which the pressurised air acts, and is therefore proportional to the diameter of the piston ØA less the diameter of the piston nose ØB. It is desirable that the lift force be maximised within the hammer as the lift distance has a direct bearing on impact value and, in turn, drilling speed. Increasing the diameter of the piston nose to increase the strength of the piston results in a lower lift force, thereby detrimentally affecting performance of the drill.

It is therefore desirable to provide a hammer having a footvalve-less design in which piston strength and lift force are maximised.

SUMMARY OF THE INVENTION

According to an aspect of the present invention, there is provided a down-the-hole hammer comprising an external cylindrical outer wear sleeve, a sliding piston mounted for reciprocating movement within the outer wear sleeve to strike a percussion bit of a drill bit assembly located at the forward end of the outer wear sleeve, wherein the drill bit assembly comprises:

a percussion bit having a head portion formed with an axially extending stub shank; axially extending splines on the stub shank slideably engageable with complementary splines formed on a drive chuck whereby rotational drive from the chuck may be transmitted to the stub shank; a bit retaining ring adapted for engagement with a retaining shoulder on the stub shank to retain the stub shank in the drill bit assembly; and engagement means on the chuck adapted for connecting the chuck to a drive means of the fluid-operated percussion drill tool; the bit retaining ring comprises a shoulder for engagement with an upper end of the chuck to hold the retaining ring in place in the assembly;

characterised in that the assembly further comprises:

a bushing arranged above the chuck;

wherein an upper portion of the bushing has an internal diameter dimensioned to provide a sealing fit with the piston nose; and the bit retaining ring or the lower portion of the bushing has an internal diameter dimensioned to provide a close sliding fit with the outer diameter of the retaining shoulder on the stub shank.

A first advantage of this arrangement is that the close sliding fit between the retaining shoulder and the bushing or retaining ring improves the stability of the bit. A further and more important advantage of this arrangement is that, because of the sealing fit between the piston nose and the bushing and the bushing or retaining ring and the bit, pressurised air supplied to the hammer is trapped between the piston nose and the bushing to boost the lift force applied to the piston. As the piston comes into contact with the upper face of the bit, air is exhausting from the piston bore. The close sliding fit between the bushing or retaining ring and the retaining shoulder on the stub shank prevents air from exhausting down the sides of the bit. Thus, when the piston comes into sealing contact with the upper end of the bushing, a chamber of trapped air is created within the bushing which boosts the lift force applied to the piston, as the pressurised air now acts on a greater area than in prior art systems.

In one embodiment, the shoulder of the bit retaining ring is an outwardly directed abutment provided at an upper end thereof and disposed above the chuck to hold the retaining ring in place in the assembly and the bushing is arranged such that the outwardly directed abutment is held in place between an upper end of the chuck and a lower portion of the bushing.

Preferably, the retaining shoulder is substantially cylindrical. The internal profile of the retaining ring and/or the lower part of the bushing may also be cylindrical.

According to a preferred embodiment of the invention, the bit retaining ring is formed with at least one slot at a lower end thereof. For example, the bit retaining ring may be formed with a pair of diametrically opposed slots at a lower end thereof. An advantage of this arrangement is that, when the bit drops out, the cushion of air trapped between the piston nose and the bit is allowed to exhaust through the slots and between the bit and the chuck. This prevents the hammer from damaging itself by continuing to cycle.

The internal diameter of the lower portion of the bushing may be larger than the internal diameter of the upper portion of the bushing such that an internal shoulder is formed in the bushing between the upper and lower portions thereof. The piston nose may be formed, in a known manner, with a portion of increased diameter ØB. This portion of the piston may form the seal with the upper portion of the bushing when the hammer is in the strike position. The position of the shoulder, that is, the change in internal diameter of the bushing, is selected to optimise the overlap between the sealing portion of the piston nose and the upper part of the bushing. The shorter the overlap (that is, the higher the internal shoulder in the bushing), the sooner the air is exhausted from the hammer when the bit drops out.

In some embodiments, the lower portion of the bushing provides the close sliding fit with the outer diameter of the retaining shoulder on the stub shank.

In other embodiments, the bit retaining ring provides the close sliding fit with the outer diameter of the retaining shoulder. In these embodiments, the length of the lower extension portion of the chuck, which protects the outer wear sleeve from excessive wear, may be increased as compared with embodiments in which the bushing provides the sliding fit with the retaining shoulder.

Optionally, the stub shank is formed with an extension tube at an upper end thereof, the extension tube having an outer diameter corresponding to an inner diameter of the piston bore, such that the extension tube is dimensioned to form a seal with the piston bore. An advantage of this arrangement is that it further adds to the boost provided by the air cushion trapped between the piston nose and the upper end of the bit by increasing the portion of the piston stroke over which the cushion of air is achieved, that is, the piston comes into sealing contact with the bit earlier than it would otherwise.

Additionally, air may be supplied between the piston and the bit strike face over a portion of the stroke length. The portion of the stroke length is preferably less than or equal to the length of the extension tube. This may be achieved by providing the internal shoulder towards an upper end of the bushing, such that the upper portion of the bushing having the internal diameter dimensioned to provide a sealing fit with the piston nose is relatively short. The sealing position of the piston with the aligner is therefore moved upwards as compared with the embodiments of the invention described above. In this embodiment, there is no overlap between the upper portion of the bushing and the sealing portion of the piston nose when the piston is in the strike position and so air is supplied to the boost chamber in the strike position. The distance moved by the piston between the strike position and the point at which the upper portion of the bushing overlaps the sealing portion of the piston nose is preferably shorter than the length of the extension tube on the stub shank. An advantage of this arrangement is that the boost effect of the air trapped between the piston nose and the bit is further enhanced, since as the piston moves upwards, air is supplied in the clearance between the piston nose and the upper portion of the bushing until the piston nose seals with the upper portion of the bushing. By shifting the internal shoulder upwards towards the upper end of the bushing, this boost effect is provided over a larger portion of the stroke. The portion of the stroke over which the boost effect is provided is also dependent on the length of the extension tube on the stub shank.

BRIEF DESCRIPTION OF THE DRAWINGS

Embodiments of a down-the-hole hammer in accordance with the invention will now be described with reference to the accompanying drawings, wherein.

DETAILED DESCRIPTION OF THE DRAWINGS

Figures 1, 2, 3:
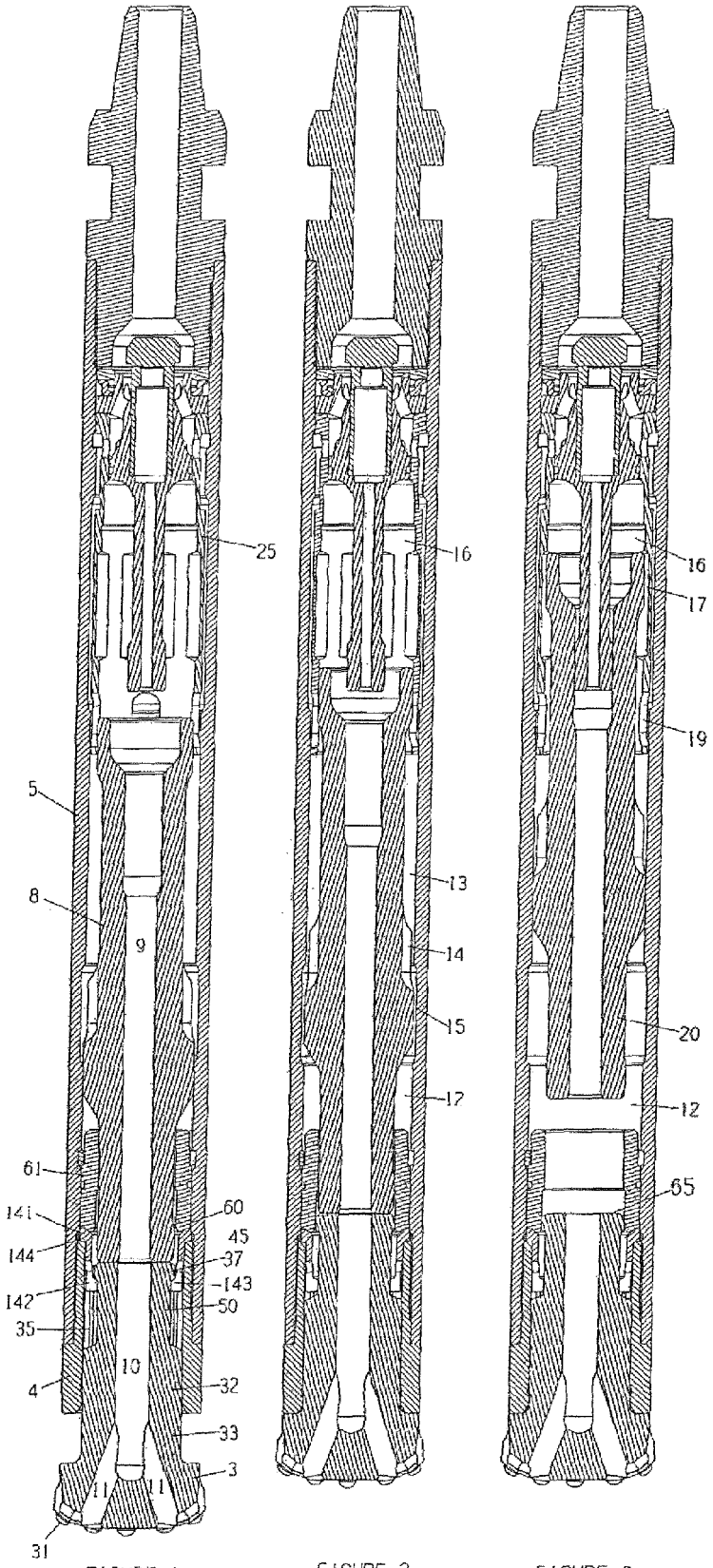
FIG. 1 is a sectional side elevation of a down-the-hole hammer according to an embodiment of the second aspect of the invention, showing the hammer in an off-bottom position.
FIG. 2 is a sectional side elevation of the down-the-hole hammer of FIG. 1, showing the piston in the strike position.
FIG. 3 is a sectional side elevation of the down-the-hole hammer of FIG. 1, showing the piston in the top-of-stroke position.

A down-the-hole hammer according to a first embodiment of the invention is shown in FIGS. 1 to 6. The hammer comprises an external cylindrical outer wear sleeve 5. An inner cylinder 25 is mounted co-axially within the outer wear sleeve. A sliding piston 8 is mounted for reciprocating movement within the inner cylinder and the outer wear sleeve, to strike a hammer bit 1 located at the forward end of the outer wear sleeve to exercise a percussive force to the drill bit. Rotational forces are transferred from the rotating outer wear sleeve by means of a chuck 4. The wear sleeve 5 is threadably connected to a drill string which is connected to a rotation motor on a drilling rig at the surface.

The head portion 3 of the bit assembly comprises the percussion bit 1 which is provided with tungsten carbide inserts 31, in a well-known manner. The bit head portion 3 is formed with an axially extending stub shank 32. The stub shank 32 is formed with a lower splined portion 33, provided with a plurality of axially extending splines 36, an upper annular retaining shoulder portion 37 and an intermediate portion 50. The retaining shoulder 37 and the intermediate portion 50 are not provided with splines. The upper annular retaining shoulder portion 37 is substantially cylindrical. The shoulder has a diameter ØD and is formed with a continuous circular top face 65.

Rotational torque is applied to the bit head portion 3 through the chuck 4. The hollow cylindrical chuck 4 is machined internally to provide a plurality of axially extending internal splines 35 on its internal wall which engage with the splines 36 of the shank 32 to transmit rotational drive from the chuck 4 to the drill bit. An upper part of the chuck 4 is externally screw threaded. The chuck 4 is also provided with an external annular shoulder 38, which acts as a stop when the chuck 4 is screwed into the wear sleeve.

Figure 4:
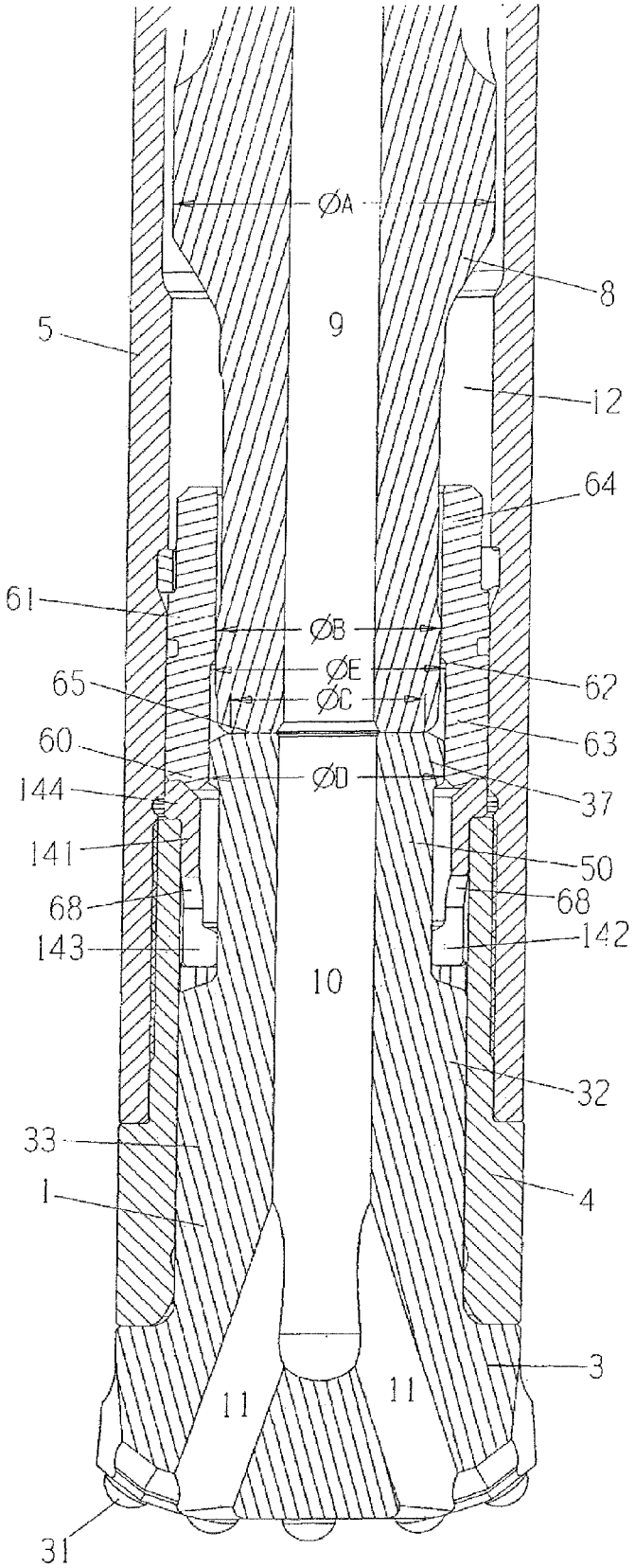
FIG. 4 is an enlarged sectional side elevation of the lower part of FIG. 2.
Figure 5:
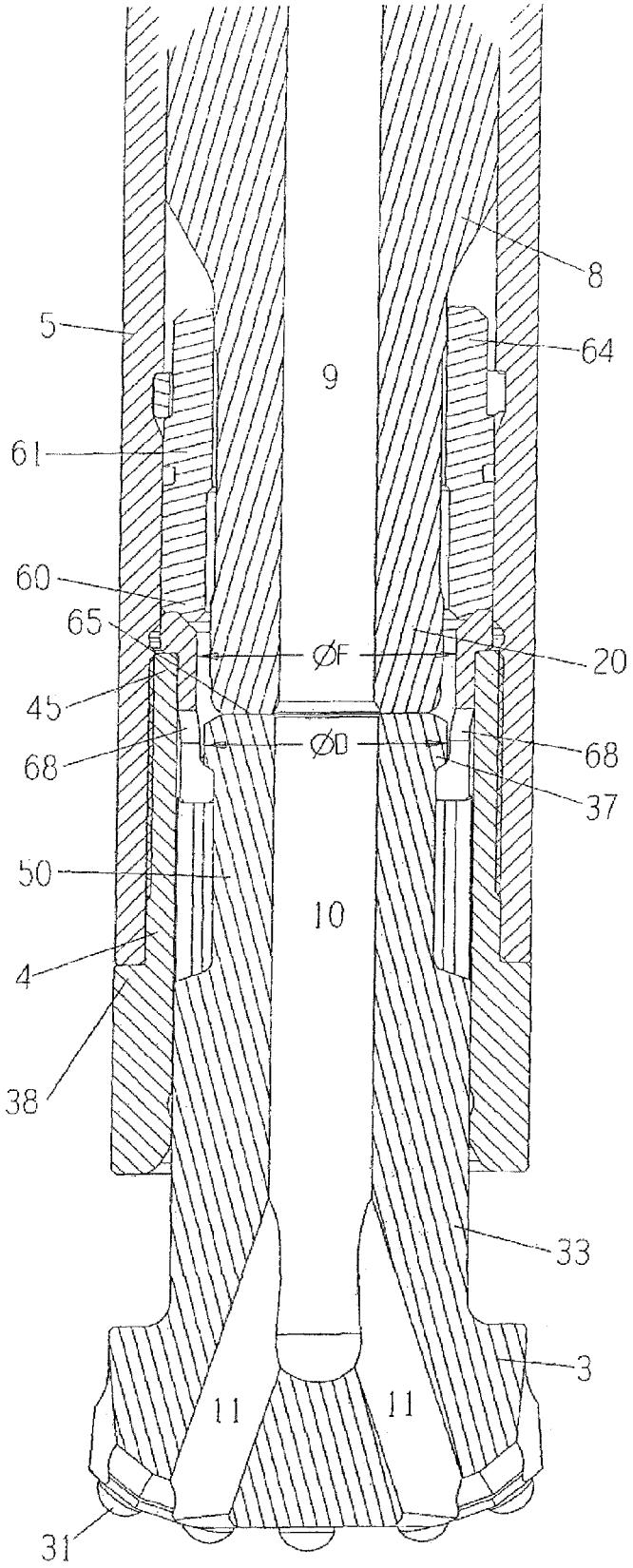
FIG. 5 is an enlarged sectional side elevation of the lower part of FIG. 1.
Figure 6:
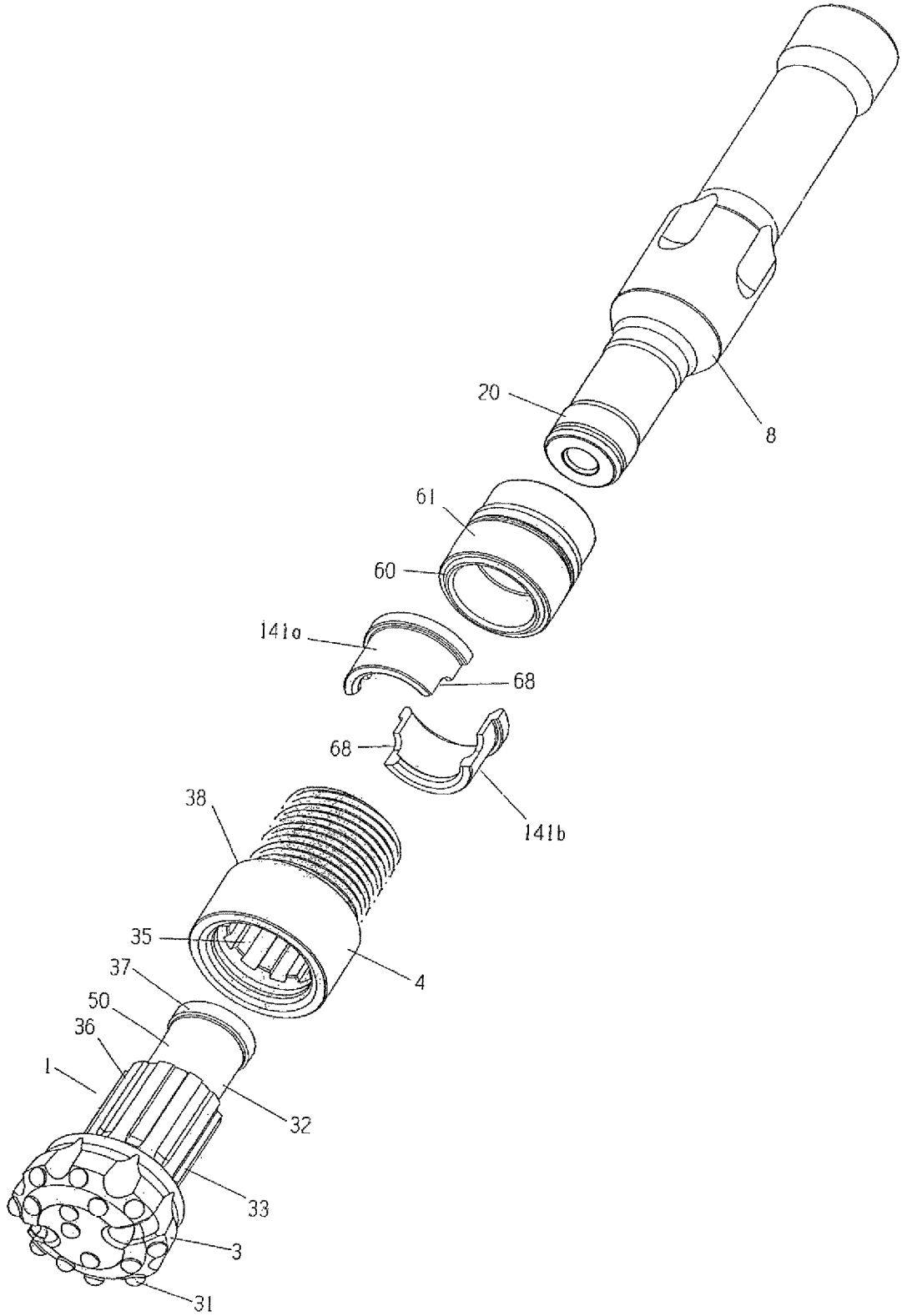
FIG. 6 is an exploded perspective view of the bit coupling system of the down-the-hole hammer of FIG. 1.

The assembly further comprises a bit retaining ring 141. As shown in FIG. 6, the ring 141 is formed in two half-annular parts 141*a*, 141*b* for ease of assembly. The inner diameter ØF of the bit retaining ring 141 is larger than the diameter ØD of the upper end 37 of the bit. As shown in FIGS. 4 and 5, when the down-the-hole hammer is assembled, a lower portion 142 of the ring 141 is disposed within the chuck. The lower end of the ring 141 is formed with an inwardly directed abutment or shoulder 143. The bit retaining ring 141 is additionally provided with an outwardly directed abutment or shoulder 144 at an upper end thereof. In the assembled bit assembly, the inwardly directed abutment 143 engages with the retaining shoulder 37 on the stub shank 32 to retain the stub shank in the drill bit assembly. The bit retaining ring 141 is formed with a pair of slots 68 at its lower end 142. The chuck 4 is screwed into the lower end of the wear sleeve so that shoulder 144 of the retaining ring 141 is held in place between the upper end 45 of the chuck 4 and a lower end 60 of an aligner or bushing 61. In addition, the screw-threaded engagement of the chuck 4 with the wear sleeve 5 enables rotational torque to be transmitted from the wear sleeve through the chuck 4 to the bit 1.

An upper portion 64 of aligner or bushing 61 has an internal diameter which provides a close sliding fit with the diameter ØB of the piston nose 20. This ensures that when the piston 8 moves into the strike position (shown in FIG. 2) the pressurised air supplied to lift chamber 12 is sealed off by the piston nose 20 and aligner 61. The aligner or bushing 61 is formed with an internal shoulder 62 so that a lower portion 63 of the aligner has a larger internal diameter ØE, which is a close sliding fit with the outer diameter ØD of the upper cylindrical portion 37 of the bit about its entire circumference.

The piston 8 is mounted for reciprocating movement within the inner cylinder 25 and the outer wear sleeve 5 to strike the top face 65 of shoulder 37 to impart a percussive force to the bit. An upper portion 66 of the piston has a diameter ØA. The piston is formed with a central bore 9. The splines 35 of the chuck 4 slideably engage with the complementary splines 36 on the shank 32 so that the head portion 3 is moved axially relatively to the chuck during the percussive action. As shown most clearly in FIG. 5, when the bit 3 is in the extended position, the outwardly directed abutment 143 on the lower end of the bit retaining ring 141, which is disposed within the chuck 4, engages the retaining shoulder 37, to retain the stub shank in the drill bit assembly.

The hammer cycle is as shown in FIGS. 1 to 3. FIG. 1 and FIG. 5 show the hammer in the off-bottom position. Piston 8 is permitting exhaust air to flush through bore 9 in piston 8 and bore 10 in bit 1 to the face flushing holes 11.

FIG. 3 shows the piston 8 at the top of stroke. As described above, aligner or bushing 61 is provided in the drill assembly in place of a footvalve, to co-operate with piston nose 20. As piston nose 20 is out of contact with aligner 61, lift chamber 12 is open to exhaust through aligner 61 and bores 10, 11. Top chamber 16 is supplied with pressurised air through ports 19 and channels 17. The chamber 16, is sealed by the distributor probe 18. As a result the piston is forced down to strike the bit. As the piston 8 comes into contact with the upper face 65 of the bit, air is exhausting from the piston bore 9. Because of the seal between the lower portion 63 of the aligner and the upper portion 37 of the bit, no air can exhaust down the sides of the bit. Thus, all of the air is flushed through the bit bore, creating a chamber of air around the strike face of the bit, regardless of the position of the piston. As the piston comes into contact with the bit, some of this air will be trapped in a "boost chamber" between the piston and the bit.

FIGS. 2 and 4 show the hammer in the strike position. Pressurised air is supplied down chamber 13, through piston grooves 14 and wear sleeve undercut 15, into the pressure chamber 12. This air is sealed off by the piston nose 20 and aligner 61. Simultaneously, the top chamber 16 is open to exhaust through bores 9, 10 and 11. As a result the piston 8 lifts and repeats the cycle. The air trapped in the "boost chamber" serves as a sort of "cushion" which boosts the lift force as the pressurised air will act on a greater area than before, that is, an area proportional to ØA-ØC.

When the bit 1 drops out, it is important to exhaust the air trapped between the piston nose 20 and the upper portion 37 of the bit. Because the diameter ØF of the upper portion 67 of the bit retaining ring 141 is greater than the diameter of the upper portion 37 of the bit, the "cushion" of air trapped between the piston nose and the bit exhausts through slots 68 and between the bit 1 and the chuck 4.

Figure 7:
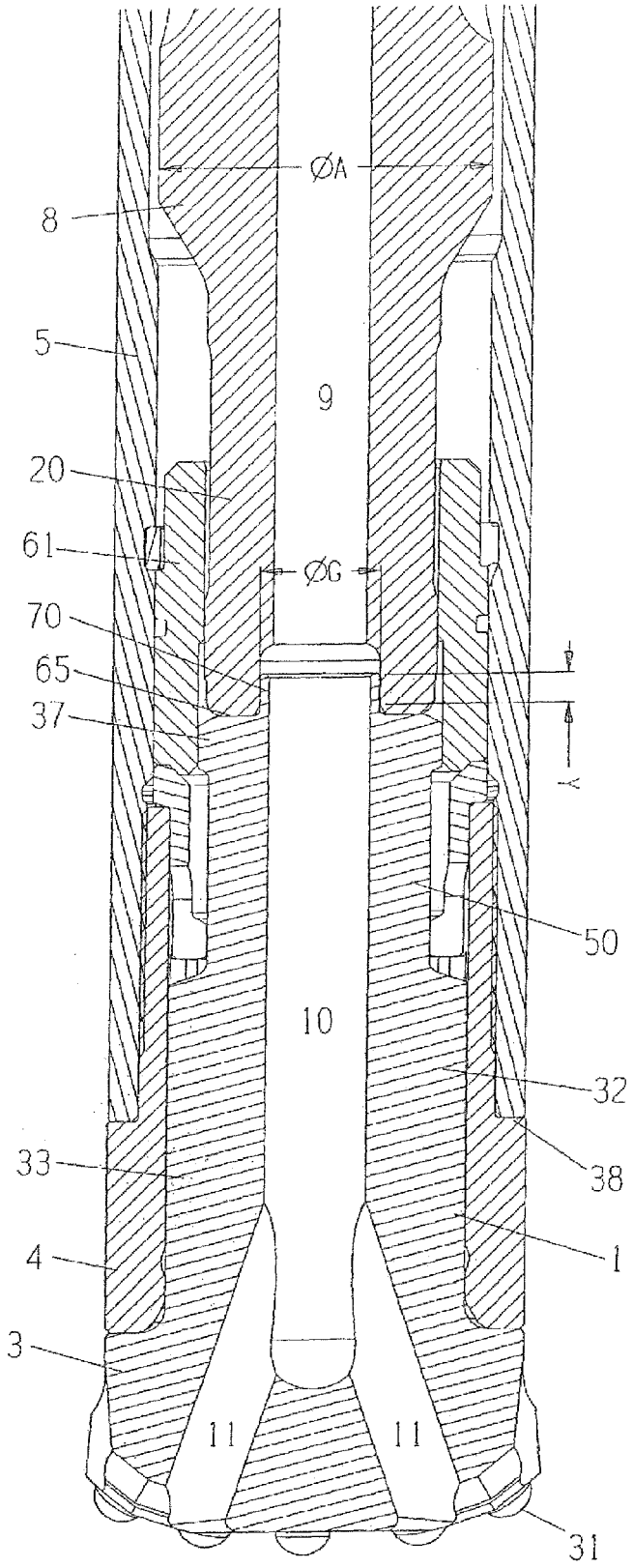
FIG. 7 is an enlarged sectional side elevation of a lower part of a down-the-hole hammer according to another embodiment of the invention.

A second embodiment of a hammer according to the invention is shown in FIG. 7. In this embodiment, the drill bit 1 is formed with an extension tube 70 at an upper end thereof. The extension tube extends from the top face 65 of the bit and has a diameter ØG, which is dimensioned to form a seal with the piston bore 9. As shown in FIG. 7, a recess is provided in the piston bore, the internal diameter of which is dimensioned to form a seal with the extension tube 70. This further adds to the boost provided by the air trapped between the piston nose and the strike face 65 of the bit by increasing the portion of the piston stroke over which the "cushion" of air is achieved by length Y.

Figure 8:
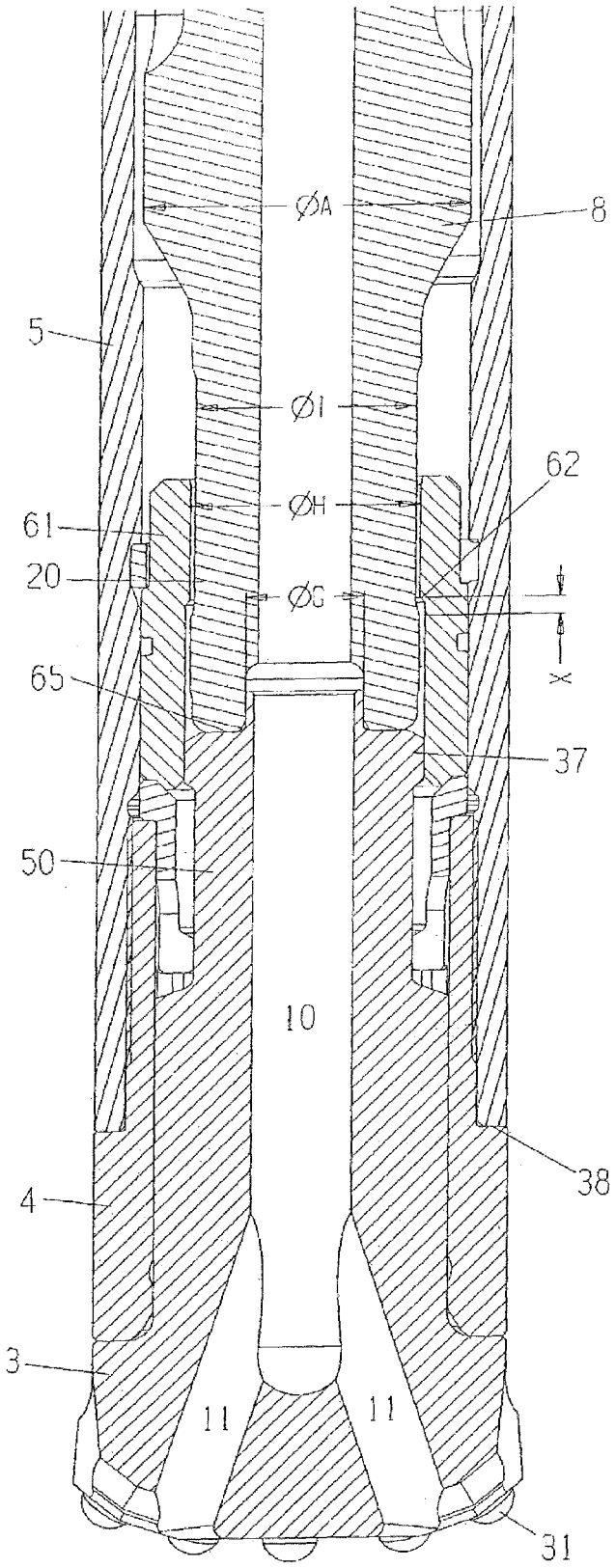
FIG. 8 is an enlarged sectional side elevation of a lower part of a down-the-hole hammer according to a third embodiment of the invention.

A third embodiment of hammer according to the invention is shown in FIG. 8. In this embodiment, the shoulder 62 in the aligner 61 is shifted upwards as compared with the aligner shown in FIG. 4. This further adds to the boost effect of the air trapped between the piston nose 20 and the strike face 65 as air is supplied in the clearance between ØI on the piston and ØH on the aligner when the piston is in the strike position, until the piston moves upwards so that the length X is closed. The length X between the strike position and the point at which the upper portion of the bushing overlaps the sealing portion of the piston nose is shorter than the length Y of the extension tube on the stub shank.

A down-the-hole hammer according to a fourth embodiment of the invention is shown in FIGS. 9 to 15. As for the previous embodiments, the hammer comprises an external cylindrical outer wear sleeve 5. An inner cylinder (not shown) is mounted co-axially within the outer wear sleeve. A sliding piston 8 is mounted for reciprocating movement within the inner cylinder and the outer wear sleeve, to strike a hammer bit 1 located at the forward end of the outer wear sleeve to exercise a percussive force to the drill bit. Rotational forces are transferred from the rotating outer wear sleeve by means of a chuck 4. The wear sleeve 5 is threadably connected to a drill string which is connected to a rotation motor on a drilling rig at the surface.

The head portion 3 of the bit assembly comprises the percussion bit 1 which is provided with tungsten carbide inserts 31, in a well-known manner. The bit head portion 3 is formed with an axially extending stub shank 32. The stub shank 32 is formed with a lower splined portion 33, provided with a plurality of axially extending splines 36, an upper annular retaining shoulder portion 37 and an intermediate portion 50. The shoulder 37 and the intermediate portion 50 are not provided with splines. The upper annular retaining shoulder portion 37 is formed with a continuous circular top face 65 and is substantially cylindrical.

Rotational torque is applied to the bit head portion 3 through the chuck 4. The hollow cylindrical chuck 4 is machined internally to provide a plurality of axially extending internal splines 35 on its internal wall which engage with the splines 36 of the shank 32 to transmit rotational drive from the chuck 4 to the drill bit. An upper part of the chuck 4 is externally screw threaded. The chuck 4 is also provided with an external annular shoulder 38, which acts as a stop when the chuck 4 is screwed into the wear sleeve.

Figure 9:
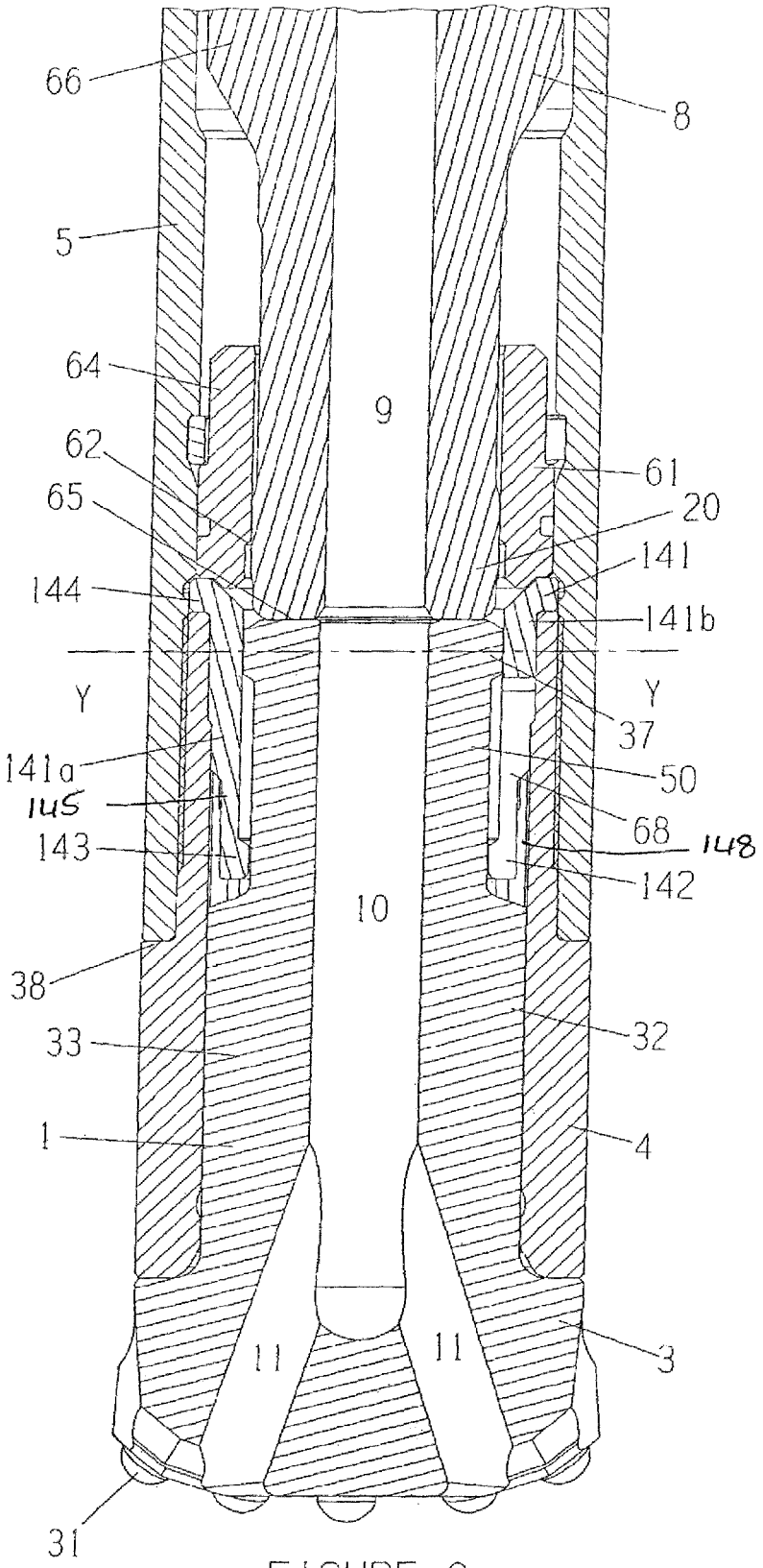
FIG. 9 is a sectional side elevation of a lower part of a down-the-hole hammer according to a fourth embodiment of the invention, showing the piston in the strike position.
Figure 10:
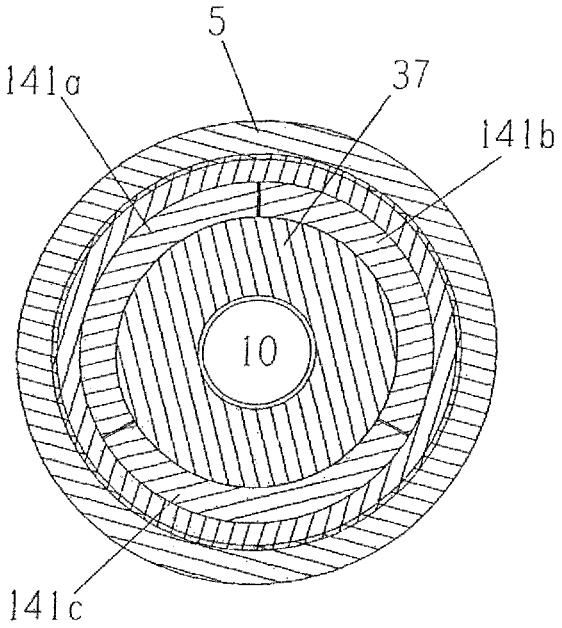
FIG. 10 is a cross-sectional view taken along line Y-Y of FIG. 9.
Figure 11:
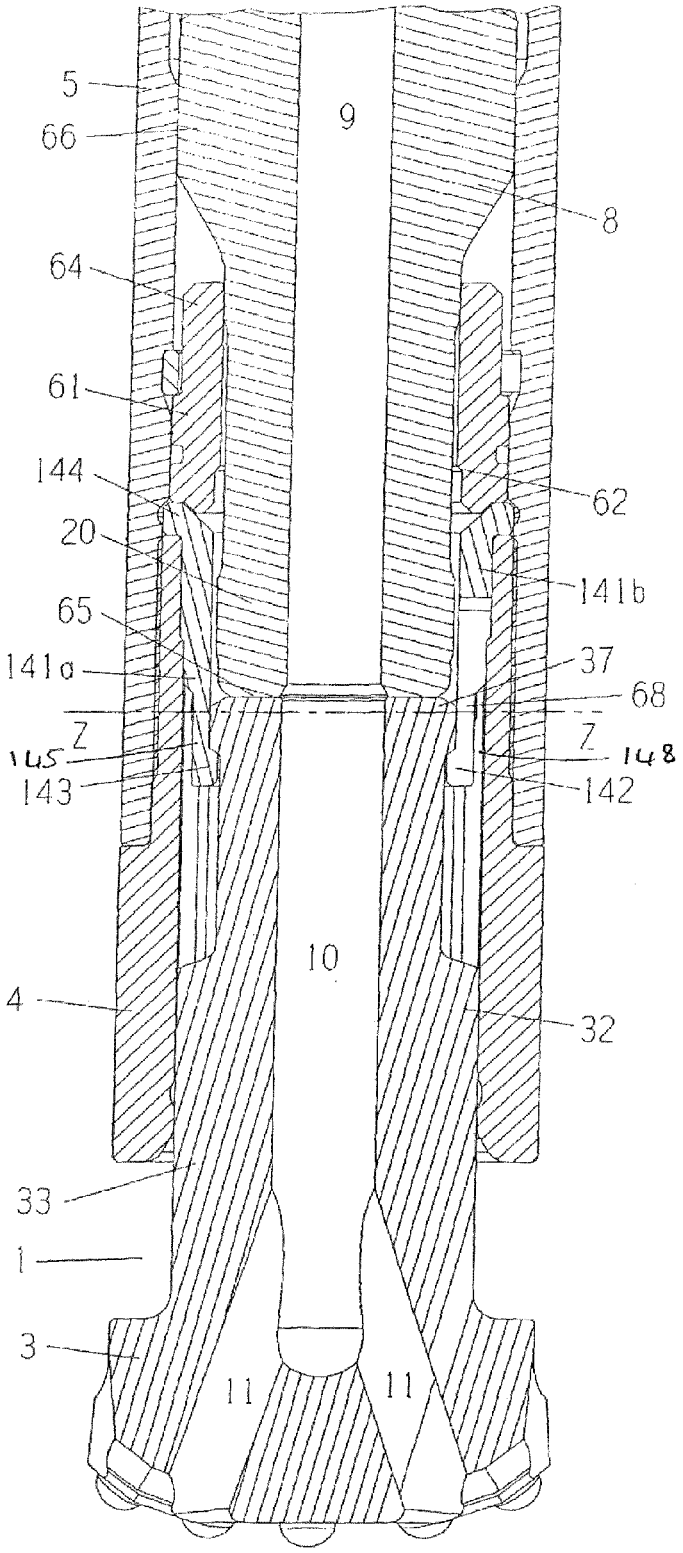
FIG. 11 is a sectional side elevation of the lower part of the hammer of FIG. 9, showing the hammer in the off-bottom position.
Figure 12:
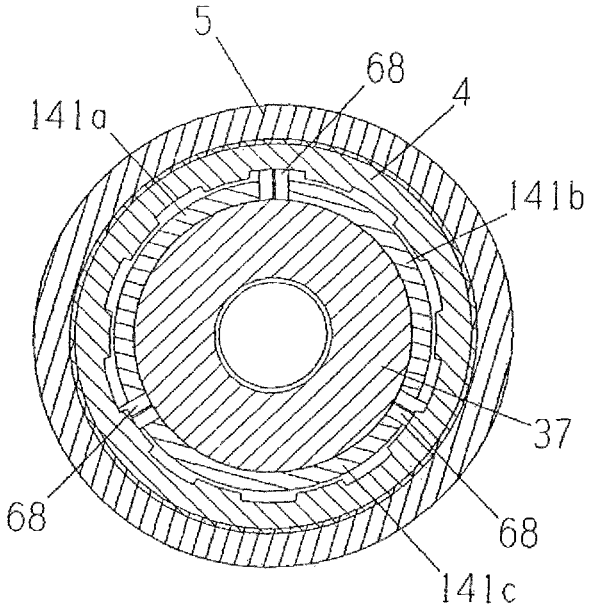
FIG. 12 is a cross-sectional view taken along line Z-Z of FIG. 11.

The assembly further comprises a bit retaining ring 141. As shown in FIG. 6, the ring 141 is formed in three part-annular sections 141*a*, 141*b*, 141*c* for ease of assembly. The inner diameter of the bit retaining ring 141 provides a close sliding fit with the upper end 37 of the bit about its entire circumference. As shown in FIGS. 9 and 11, when the down-the-hole hammer is assembled, a lower portion 142 of the ring 141 is disposed within the chuck. The lower end of the ring 141 is formed with an inwardly directed abutment or shoulder 143. The bit retaining ring 141 is additionally provided with an outwardly directed abutment or shoulder 144 at an upper end thereof. In the assembled bit assembly, the inwardly directed abutment 143 engages with the retaining shoulder 37 on the stub shank 32 to retain the stub shank in the drill bit assembly. The bit retaining ring 141 is formed with three slots 68 at its lower end 142. The outer diameter of the bit retaining ring 141 is reduced at a lower portion 145 thereof such that a chamber 148 is formed between the chuck and the bit retaining ring. This chamber 148 allows air trapped between the bit and the piston nose to exhaust when the bit drops out.

Figure 13:
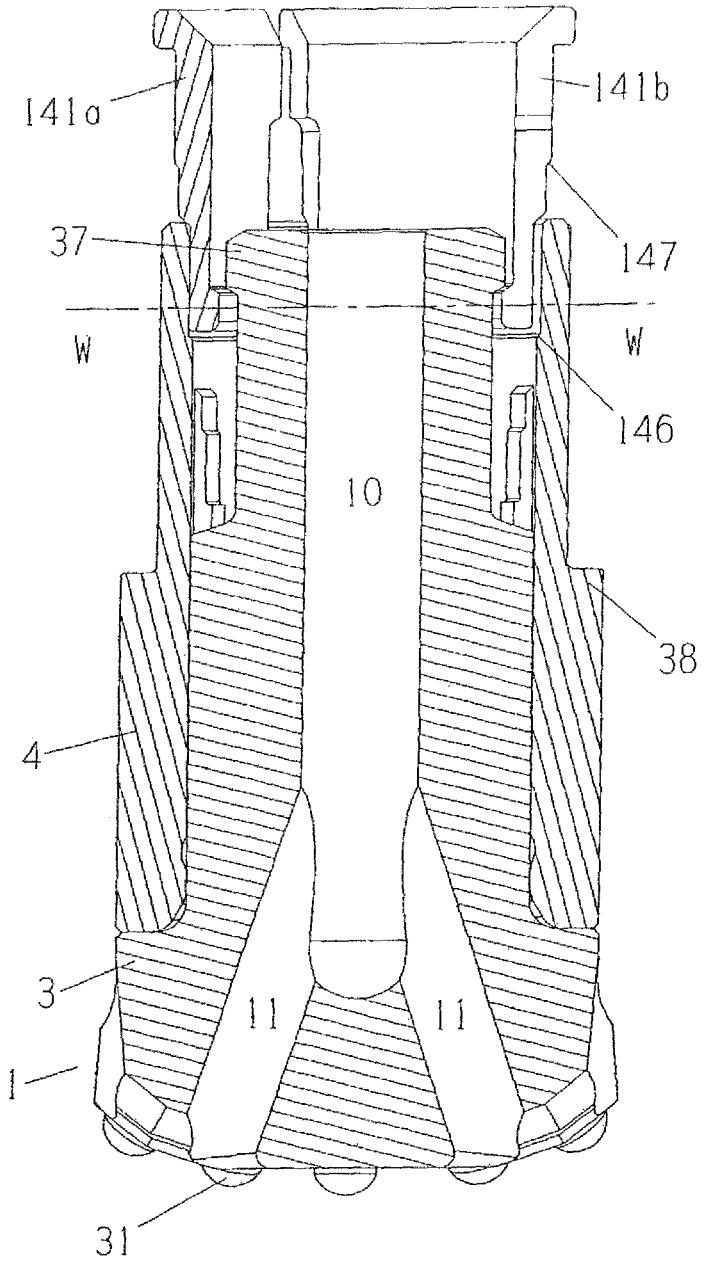
FIG. 13 is a sectional elevation of the components of the drill bit assembly of the hammer of FIG. 9, in a pre-assembled position.
Figure 14:
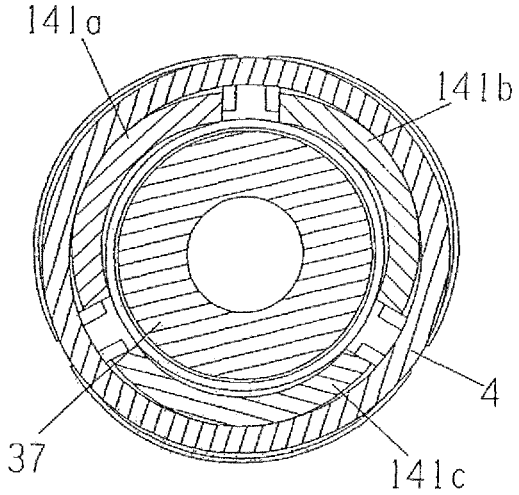
FIG. 14 is a cross-sectional view taken along line W-W of FIG. 13.
Figure 15:
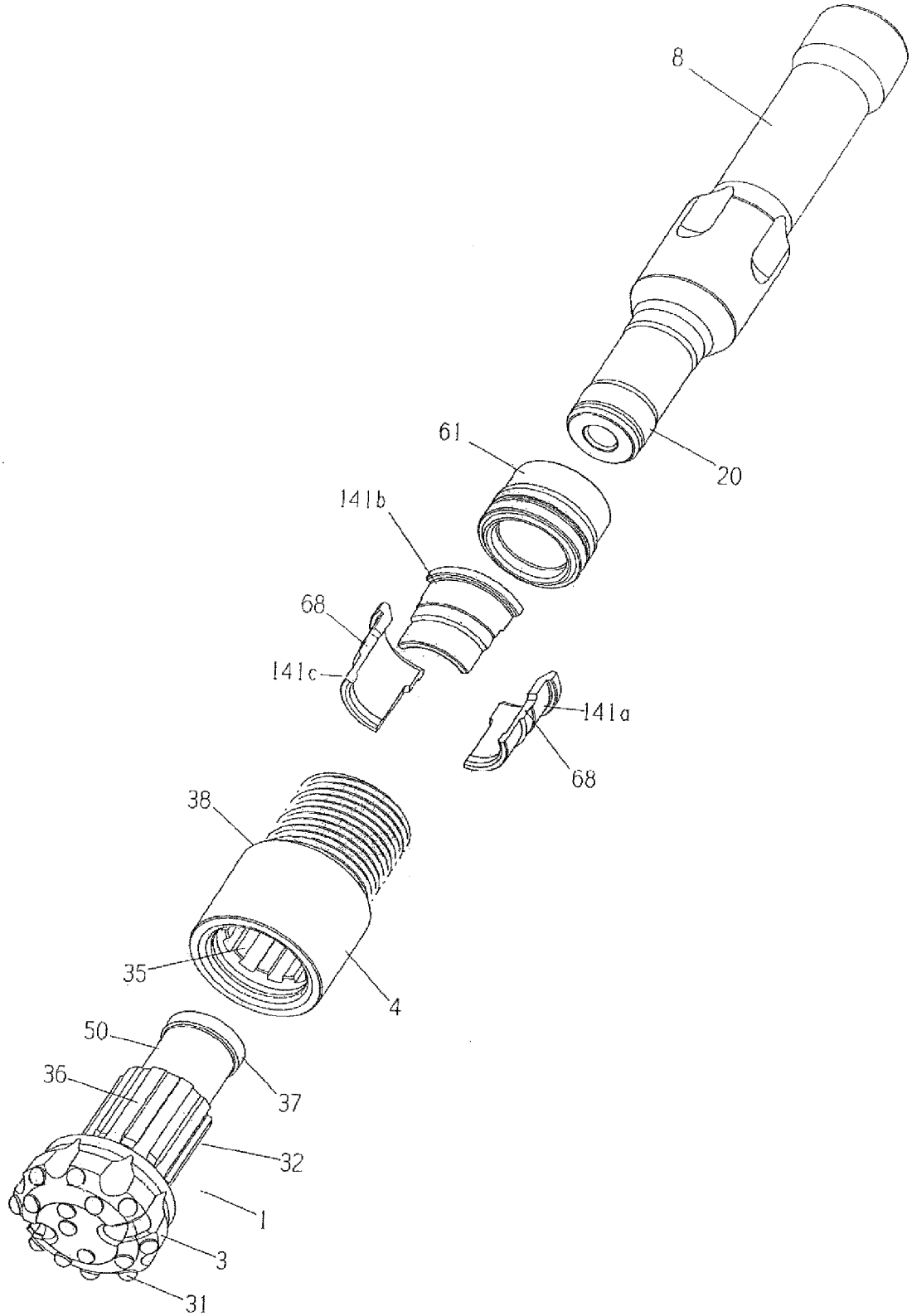
FIG. 15 is an exploded perspective view of the bit coupling system of the down-the-hole hammer of FIG. 9.

As shown in FIG. 13, the hollow chuck 4 is provided with an internal counterbore, so that the internal bore of the chuck has an increased diameter at an upper end thereof.

The diameter of the internal bore of the chuck is tapered to provide an internal wedging (cam) surface 146 at an upper end of the chuck 4. The retaining ring 141 has an increased diameter at an upper end thereof and a tapered shoulder 147, corresponding in shape to the wedging (cam) surface 146, is provided at an intermediate portion thereof. The tapered surface 146 of the chuck 4 and the shoulder 147 on the bit retaining ring co-operate to ease insertion of the ring into the chuck, as the tapered surface 146 has a wedging or swaging effect on the ring 141. The chuck 4 is screwed into the lower end of the wear sleeve so that shoulder 144 of the retaining ring 141 is held in place between the upper end 45 of the chuck 4 and a lower end 60 of an aligner or bushing 61. In addition, the screw-threaded engagement of the chuck 4 with the wear sleeve 5 enables rotational torque to be transmitted from the wear sleeve through the chuck 4 to the bit 1.

An upper portion 64 of aligner or bushing 61 has an internal diameter which provides a close sliding fit with the outer diameter of the piston nose 20. This ensures that when the piston 8 moves into the strike position (shown in FIG. 9) the pressurised air supplied to lift chamber 12 is sealed off by the piston nose 20 and aligner 61. The aligner or bushing 61 is formed with a shoulder 62 so that a lower portion 63 of the aligner has a larger internal diameter.

The piston 8 is mounted for reciprocating movement within the inner cylinder 25 and the outer wear sleeve 5 to strike the top face 65 of shoulder 37 to impart a percussive force to the bit. An upper portion 66 of the piston has a diameter ØA. The piston is formed with a central bore 9. The splines 35 of the chuck 4 slideably engage with the complementary splines 36 on the shank 32 so that the head portion 3 is moved axially relatively to the chuck during the percussive action. As shown most clearly in FIG. 11, when the bit 3 is in the extended position, the outwardly directed abutment 143 on the lower end of the bit retaining ring 141, which is disposed within the chuck 4, engages the retaining shoulder 37, to retain the stub shank in the drill bit assembly.

The hammer cycle is substantially as described above with reference to FIGS. 1 to 3. FIG. 11 shows the hammer in the off-bottom position. Piston 8 is permitting exhaust air to flush through bore 9 in piston 8 and bore 10 in bit 1 to the face flushing holes 11.

Aligner or bushing 61 is provided in the drill assembly in place of a footvalve, to co-operate with piston nose 20. In the top of stroke position (not shown), piston nose 20 is out of contact with aligner 61, and so lift chamber 12 is open to exhaust through aligner 61 and bores 10, 11. Top chamber 16 is supplied with pressurised air through ports 19 and channels 17. The chamber 16 is sealed by the distributor probe 18. As a result the piston is forced down to strike the bit. As the piston 8 comes into contact with the upper face 65 of the bit, air is exhausting from the piston bore 9. Because of the seal between retaining ring 141 and the upper portion 37 of the bit, no air can exhaust down the sides of the bit. Thus, all of the air is flushed through the bit bore, creating a chamber of air around the strike face of the bit, regardless of the position of the piston. As the piston comes into contact with the bit, some of this air will be trapped in a "boost chamber" between the piston and the bit.

FIG. 9 shows the hammer in the strike position. Pressurised air is supplied down chamber 13, through piston grooves 14 and wear sleeve undercut 15, into the pressure chamber 12. This air is sealed off by the piston nose 20 and aligner 61. Simultaneously, the top chamber 16 is open to exhaust through bores 9, 10 and 11. As a result the piston 8 lifts and repeats the cycle. The air trapped in the "boost chamber" serves as a sort of "cushion" which boosts the lift force as the pressurised air will act on a greater area than before, that is, an area proportional to ØA-ØC.

When the bit 1 drops out, it is important to exhaust the air trapped between the piston nose 20 and the upper portion 37 of the bit. In this embodiment, the internal diameter of the bit retaining ring 141 is substantially the same as the diameter of the upper portion 37 of the bit. However, the outer diameter of the retaining ring 141 is reduced at a lower portion 145 thereof, so that a chamber 148 is formed between the retaining ring and the chuck. The "cushion" of air trapped between the piston nose and the bit exhausts through slots 68 into this chamber 148 and out between the bit 1 and the chuck 4.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Having described the invention, the following is claimed:

1. A down-the-hole hammer comprising an external cylindrical outer wear sleeve, a sliding piston mounted for reciprocating movement within the outer wear sleeve, the piston defining a piston bore therethrough and having a piston nose at a forward end thereof to strike a bit strike face of a percussion bit of a drill bit assembly located at the forward end of the outer wear sleeve, wherein the drill bit assembly comprises:

a percussion bit having a head portion formed with an axially extending stub shank; axially extending splines on the stub shank slideably engageable with complementary splines formed on a drive chuck whereby rotational drive from the chuck may be transmitted to the stub shank; a bit retaining ring adapted for engagement with a retaining shoulder on the stub shank to retain the stub shank in the drill bit assembly; and engagement means on the chuck adapted for connecting the chuck to a drive means of the fluid-operated percussion drill tool; the bit retaining ring comprises a shoulder for engagement with an upper end of the chuck to hold the retaining ring in place in the assembly;

characterised in that the assembly further comprises:

a bushing arranged above the chuck, the bushing having an upper portion and a lower portion;

wherein the upper portion of the bushing has an internal diameter dimensioned to provide a sealing fit with the piston nose; and the bit retaining ring has an internal diameter dimensioned to provide a close sliding fit with an outer diameter of the retaining shoulder on the stub shank about the entire circumference of the stub shank.

2. A down-the-hole hammer as claimed in claim 1, wherein the retaining shoulder on the stub shank is not provided with splines.

3. A down-the-hole hammer as claimed in claim 1, wherein the bit retaining ring is formed with at least one slot at a lower end thereof.

4. A down-the-hole hammer as claimed in claim 3, wherein the bit retaining ring is formed with a pair of diametrically opposed slots at a lower end thereof.

5. A down-the-hole hammer as claimed in claim 1, wherein an internal diameter of the lower portion of the bushing is larger than the internal diameter of the upper portion of the bushing such that an internal shoulder is formed in the bushing between the upper and lower portions thereof.

6. A down-the-hole hammer as claimed in claim 1, wherein the stub shank is formed with an extension tube at an upper end thereof, the extension tube having an outer diameter corresponding to an inner diameter of the piston bore, such that the extension tube is dimensioned to form a seal with the piston bore.

7. A down-the-hole hammer as claimed in claim 6, wherein air is supplied between the piston and the bit strike face over a portion of a stroke length of the piston.

8. A down-the-hole hammer as claimed in claim 7, wherein the portion of the stroke length is less than or equal to the length of the extension tube.

9. A down-the-hole hammer as claimed in claim 1, wherein the hammer is a reverse circulation down-the-hole hammer.

10. A down-the-hole hammer comprising an external cylindrical outer wear sleeve, a sliding piston mounted for reciprocating movement within the outer wear sleeve, the piston defining a piston bore therethrough and having a piston nose at a forward end thereof to strike a bit strike face percussion bit of a drill bit assembly located at the forward end of the outer wear sleeve, wherein the drill bit assembly comprises:

a percussion bit having a head portion formed with an axially extending stub shank; axially extending splines on the stub shank slideably engageable with complementary splines formed on a drive chuck whereby rotational drive from the chuck may be transmitted to the stub shank; a bit retaining ring adapted for engagement with a retaining shoulder on the stub shank to retain the stub shank in the drill bit assembly; and engagement means on the chuck adapted for connecting the chuck to a drive means of the fluid-operated percussion drill tool; the bit retaining ring comprises a shoulder for engagement with an upper end of the chuck to hold the retaining ring in place in the assembly;

characterised in that the assembly further comprises:

a bushing arranged above the chuck, the bushing having an upper portion and a lower portion;

wherein the upper portion of the bushing has an internal diameter dimensioned to provide a sealing fit with the piston nose; and the lower portion of the bushing has an internal diameter dimensioned to provide a close sliding fit with an outer diameter of the retaining shoulder on the stub shank about the entire circumference of the stub shank.

11. A down-the-hole hammer as claimed in claim 10, wherein the retaining shoulder on the stub shank is not provided with splines.

12. A down-the-hole hammer as claimed in claim 10, wherein the bit retaining ring is formed with at least one slot at a lower end thereof.

13. A down-the-hole hammer as claimed in claim 12, wherein the bit retaining ring is formed with a pair of diametrically opposed slots at a lower end thereof.

14. A down-the-hole hammer as claimed in claim 10, wherein the internal diameter of the lower portion of the bushing is larger than the internal diameter of the upper portion of the bushing such that an internal shoulder is formed in the bushing between the upper and lower portions thereof.

15. A down-the-hole hammer as claimed in claim 10, wherein the stub shank is formed with an extension tube at an upper end thereof, the extension tube having an outer diameter corresponding to an inner diameter of the piston bore, such that the extension tube is dimensioned to form a seal with the piston bore.

16. A down-the-hole hammer as claimed in claim 15, wherein air is supplied between the piston and the bit strike face over a portion of a stroke length of the piston.

17. A down-the-hole hammer as claimed in claim 16, wherein the portion of the stroke length is less than or equal to the length of the extension tube.

18. A down-the-hole hammer as claimed in claim 10, wherein the hammer is a reverse circulation down-the-hole hammer.

* * * * *